US008909085B2

(12) United States Patent
Short et al.

(10) Patent No.: US 8,909,085 B2
(45) Date of Patent: Dec. 9, 2014

(54) METHODS, PRINTERS, AND CONTROL PANELS FOR PRINTERS

(75) Inventors: David Bradley Short, San Diego, CA (US); Steve O. Rasmussen, Vancouver, WA (US); David M Lovelace, San Diego, CA (US); Ryan Lane Wilday, Escondido, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 585 days.

(21) Appl. No.: 13/243,376

(22) Filed: Sep. 23, 2011

(65) Prior Publication Data

US 2013/0077114 A1 Mar. 28, 2013

(51) Int. Cl.
*G03G 15/00* (2006.01)

(52) U.S. Cl.
CPC ..... *G03G 15/6552* (2013.01); *G03G 15/5016* (2013.01)
USPC ..... 399/81

(58) Field of Classification Search
CPC ..... G03G 15/502; G03G 15/5016
USPC ..... 399/81
See application file for complete search history.

(56) References Cited

U.S. PATENT DOCUMENTS

| | | | | |
|---|---|---|---|---|
| 4,994,988 | A | 2/1991 | Yokoi | |
| 5,764,384 | A * | 6/1998 | Wilcox et al. | 358/498 |
| 2006/0017217 | A1 * | 1/2006 | Maeda | 271/162 |
| 2006/0232002 | A1 * | 10/2006 | Watanabe et al. | 271/292 |
| 2008/0152368 | A1 * | 6/2008 | Lee | 399/45 |

* cited by examiner

*Primary Examiner* — Walter L Lindsay, Jr.
*Assistant Examiner* — Frederick Wenderoth

(57) ABSTRACT

Methods, printers, and control panels for printers are disclosed. An example printer includes a control panel, a print substrate path exit to output a print substrate from the printer in response to a printing task, and a control panel actuator to move the control panel from a first position in which the control panel at least partially obstructs a print substrate from passing through the print substrate path exit to a second position in which the control panel does not obstruct the print substrate from passing through the print substrate path exit.

19 Claims, 13 Drawing Sheets

METHODS, PRINTERS, AND CONTROL PANELS FOR PRINTERS

BACKGROUND

Desktop printers are popular devices that enable convenient printing of text or images. As the desktop printer has evolved, additional capabilities have been introduced into some desktop printers such as image scanning, printing on various print substrates or media having different characteristics, and remote printing.

DETAILED DESCRIPTION

Figure 1A:
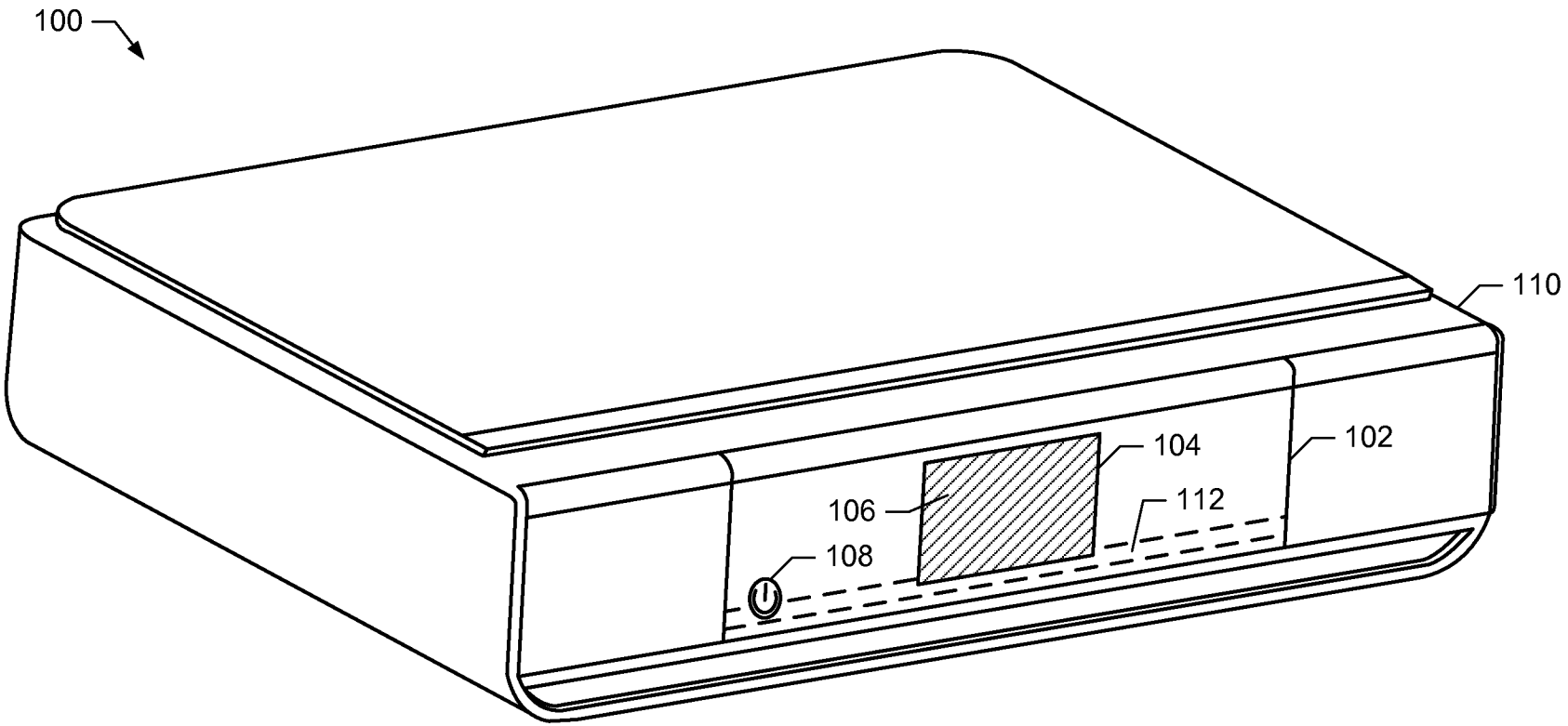
FIG. 1A illustrates an example printer constructed in accordance with the teachings of this disclosure and showing a control panel in an idle position.

Example methods, printers, and control panels for printers disclosed herein provide a control panel and a print substrate path exit that at least partially overlap. In some examples, a printer includes a control panel actuator to move a control panel from an idle position or state, in which the control panel at least partially obstructs a print substrate from passing through the print substrate path exit, to a printing position, in which the control panel does not obstruct the print substrate from passing through the exit.

Known printers use a significant portion of the printers' exterior areas to provide media input, power and data connections, product identification, and exit or output paths for the print substrate. The designs of control panels for known printers are constrained to use what space remains after the exterior area used for other functions or purposes. As a result, the path exit uses the majority of known printers' exterior surfaces, and the control panels are relatively small with limited functionality. The small control panels of known printers may be a source of frustration for users of such known printers.

Example apparatus, printers, and methods disclosed herein overcome the above problems of known printers by providing a movable control panel which, in an idle position, at least partially obstructs the print substrate path exit and, in a printing position, does not obstruct the path exit. As a result, larger control panels and/or controls may be utilized relative to known printers without increasing the overall size of the printer relative to such known printers. In some examples, a printer further includes a movable print substrate exit path that extends to an extended or printing position during a printing operation and/or retracts to a retracted or idle position when the printing operation is finished.

Example methods, printers, and control panels disclosed herein are useful for implementing, for example, desktop printers. In particular, disclosed example methods, printers, and/or control panels enable smaller or lower-profile printers to have larger controls and/or control panels, with equal or greater capabilities and ease-of-use than larger or higher-profile printers. Disclosed example methods, printers, and/or control panels therefore improve the user experience by providing enhanced control functionality and/or ease of interaction. This increased functionality and/or ease of interaction may be achieved without increasing the overall size of the printer.

As used herein, the term "desktop printer" refers to a type of printing unit that may be placed on a desk, table, stand, or other common type of support surface, and of the type that is commonly used for home, personal, office, and/or business applications. Desktop printers are to be distinguished from standing floor printers or industrial printers, the designs of which place less emphasis on the footprint of the printer than the designs of desktop printers. Such desktop printers may include additional functions such as image scanning or photocopying. While example desktop printers are disclosed herein for illustration, the examples may be modified for use in larger and/or smaller printer applications.

The "profile" or "form factor" of a printer refers to its physical size or volume when set on a support surface such as a desk or table and including its dimensions such as height. The "footprint" of a printer refers to the area of a support surface used by the printer. For example, a printer that occupies less volume (e.g., has a smaller footprint) is said to have a lower profile than a printer having a larger volume. Similarly, a printer that is shorter is said to have a lower profile than a printer that is taller, a printer that has a smaller footprint is said to have a smaller profile than a printer having a larger footprint, and a printer having a smaller width is said to have a smaller profile than a printer that is wider. Example methods, printers, and control panels for printers disclosed herein enable a reduction in the profile of printers when compared with known printers.

FIG. 1A illustrates an example printer 100 constructed in accordance with the teachings of this disclosure. The example printer 100 of FIG. 1A is a desktop printer, and includes a movable control panel 102. The example control panel 102 is illustrated in an idle position in FIG. 1A, and includes a display 104, a touchscreen input device 106, and a power button 108. The printer 100 further includes a housing 110 that defines the profile of the printer 100 and supports the control panel 102.

The example control panel 102 obstructs a print substrate output path when in the idle position illustrated in FIG. 1A. In particular, the control panel 102 obstructs sheets of paper or other types of print substrate from exiting the volume within the printer 100 along a path that would, but for the positioning of the control panel 102, pass through an area 112. Because the example control panel 102 is positioned to overlap with (e.g., occlude) the exit path of the print substrate, the printer 100 can position the control panel 102 in a convenient orientation for the user while avoiding having to increase the profile of the printer 100 to accommodate both the exit path and the control panel 102.

Figure 1B:
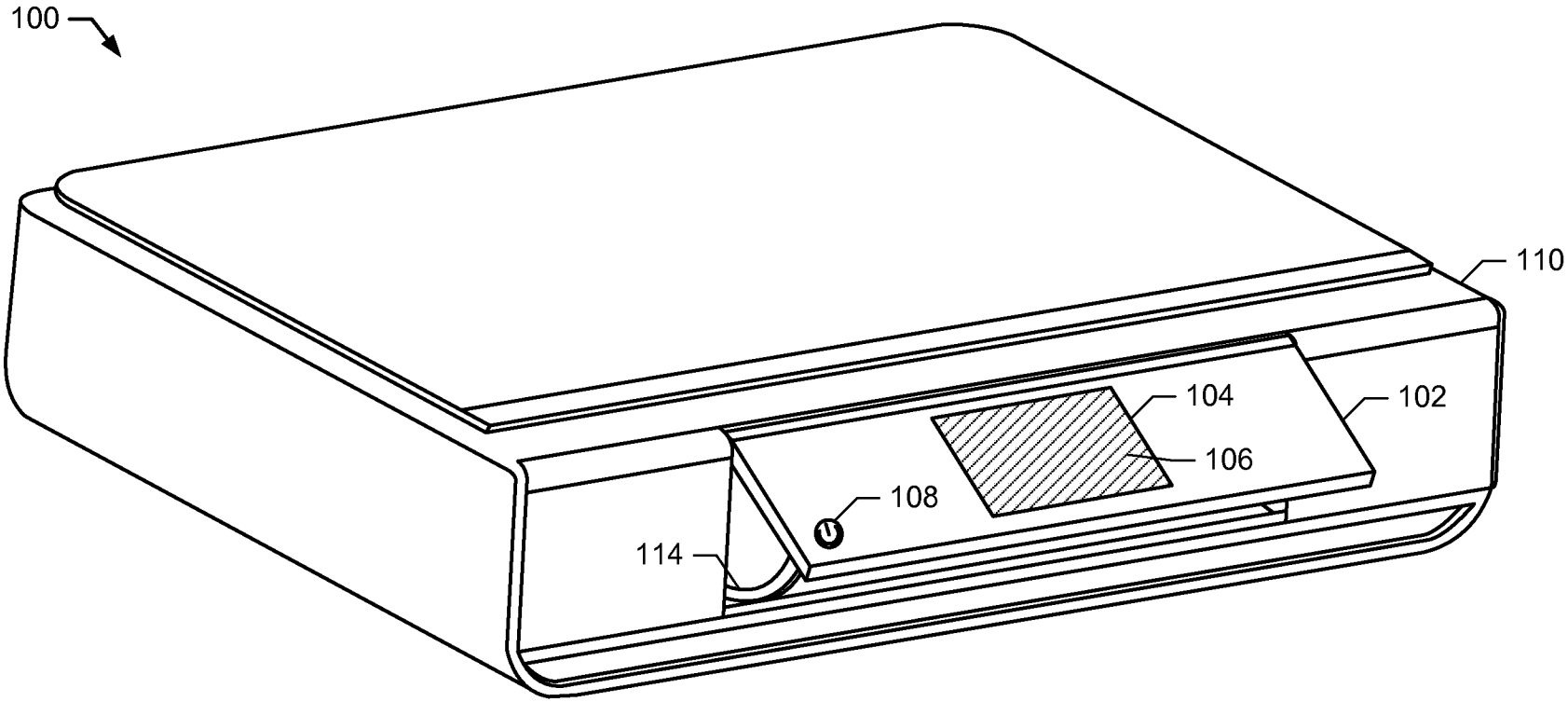
FIG. 1B illustrates the example printer of FIG. 1A with the control panel in a printing position.
Figure 4:
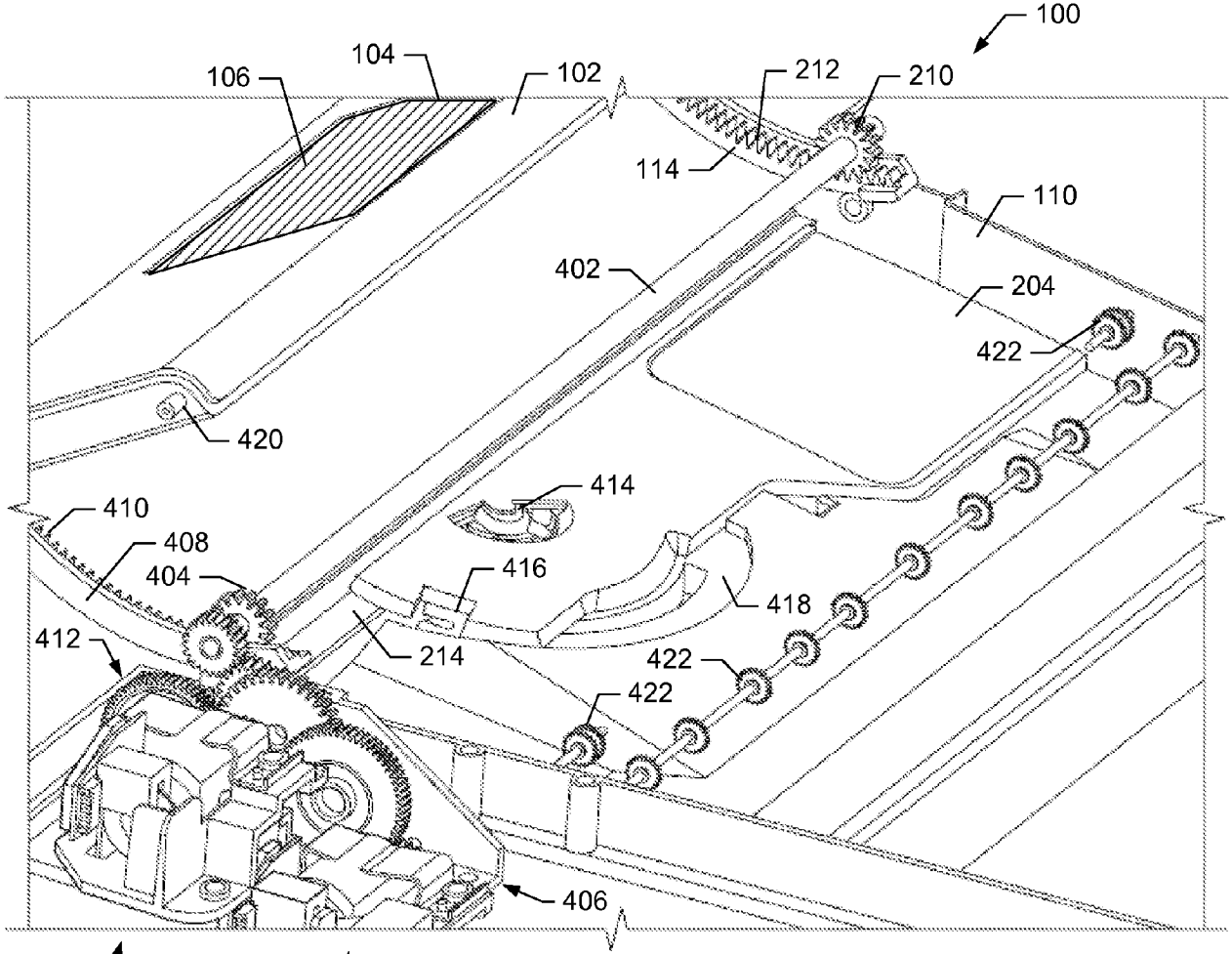
FIG. 4 is a perspective view of the example printer of FIG. 1A including the control panel in the printing state and the print substrate path exit in the retracted state.
Figure 5:
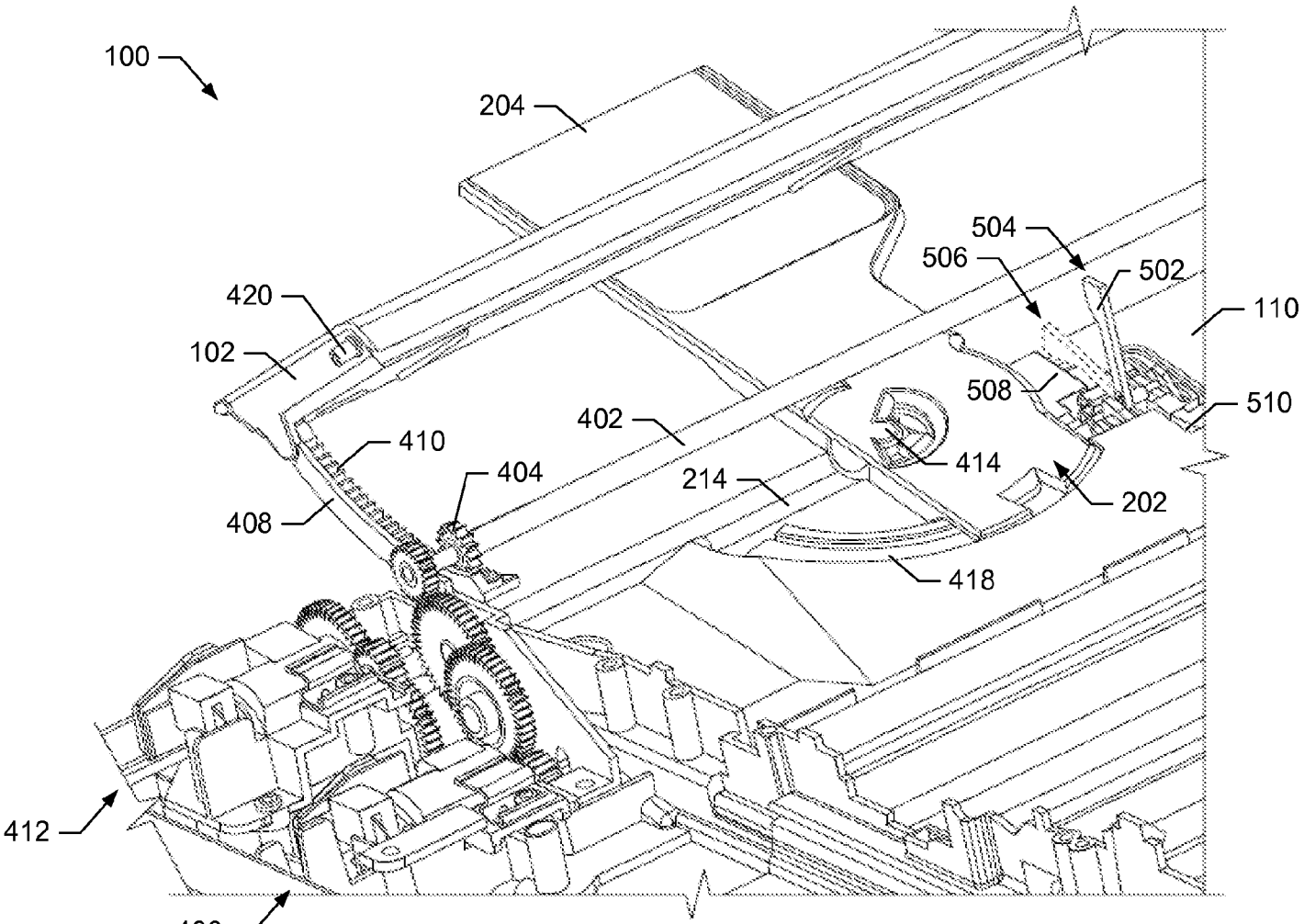
FIG. 5 is a perspective view of the example printer of FIG. 1A including a substrate detector.

FIG. 1B illustrates the example printer 100 of FIG. 1A with the control panel 102 in a printing position. The example printer 100 includes a control panel actuator that moves the control panel 102 from the idle position illustrated in FIG. 1A to the printing position illustrated in FIG. 1B. In the printing position, the control panel 102 does not obstruct the path exit. The example printer 100 includes a control panel arm 114 that supports the control panel 102 in the printing position. The control panel arm 114 is coupled to the control panel actuator and extends and/or retracts the example control panel 102 in response to the actuator. In some examples, the printer 100 includes two or more arms (e.g., a second arm which is coupled to the opposite side of the control panel from the control panel arm 114 and is obstructed by the control panel 102 in the view of FIG. 1B). A second arm is illustrated in FIGS. 4 and 5.

The example printer 100 may further include other desktop printer and/or all-in-one functions and/or features, such as image scanning, a paper input tray, transmitting facsimiles, reading memory cards, etc.

Figure 2:
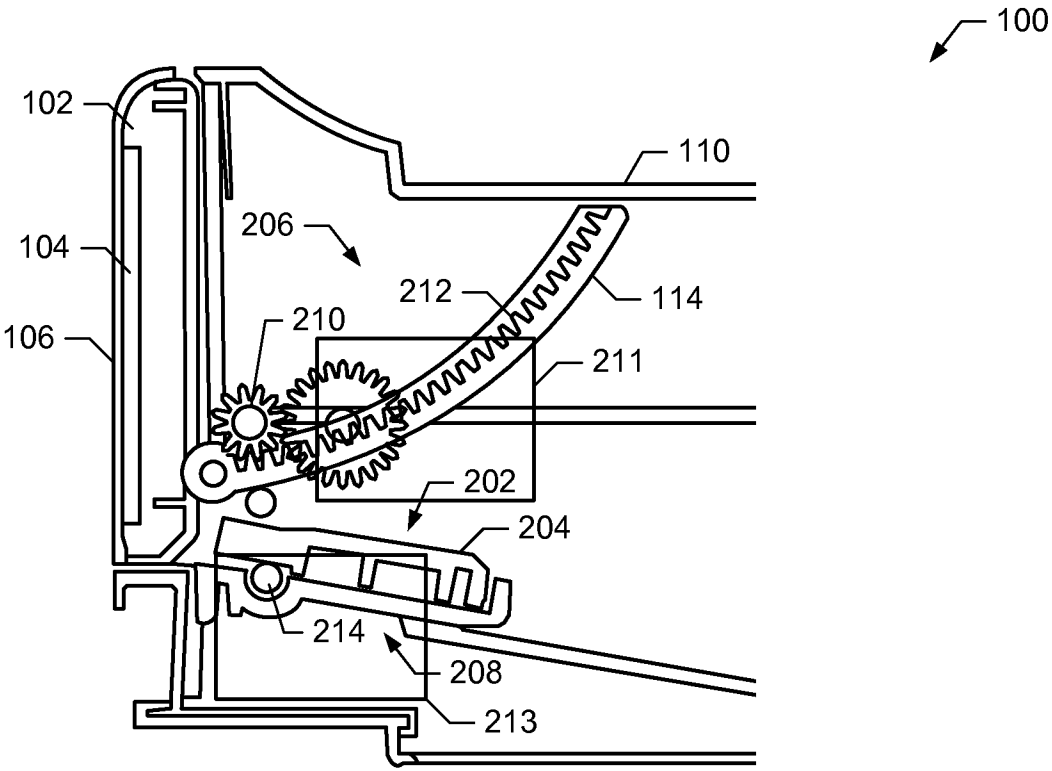
FIG. 2 is a cross-sectional view of the example printer of FIG. 1A with the control panel in an idle state and a print substrate path exit in a retracted state.

FIG. 2 is a cross-sectional view of the example printer 100 of FIG. 1A with the control panel 102 in an idle state and a print substrate path exit support 202 in a retracted state. As discussed above, the example printer 100 includes the control panel 102, the display 104, the touchscreen input device 106, the housing 110, and the arm 114. The example print substrate path exit support 202 includes an output tray 204. In the illustrated example of FIG. 2, the control panel 102 is in the idle position and obstructs movement of the output tray 204 from a retracted position (see FIG. 2) to an extended position (see FIG. 3).

As illustrated in FIG. 2, the printer 100 includes a control panel actuator 206 and an output path actuator 208. The control panel actuator 206 includes the control panel arm 114, an arm gear 210, and a control panel motor 211. The example control panel arm 114 includes teeth 212 that interface with teeth on the arm gear 210. The motor rotates the arm gear 210 clockwise and/or counterclockwise to cause the gear 210 to move the control panel arm 114 in a corresponding direction. For example, the arm gear 210 rotates clockwise to cause the arm 114 to push the bottom of the control panel 102 out while the top of the control panel 102 pivots. Conversely, the arm gear 210 rotates counter-clockwise to cause the arm 114 to pull the control panel 102 to the idle position.

The example output path actuator 208 of FIG. 2 rotates the example output tray 204 between an idle (e.g., retracted) position and a printing (e.g., extended) position. The example output path actuator 208 includes an output path motor 213 coupled to a driveshaft 214 which, in turn, is coupled to a tray gear. The output path motor 213 turns the driveshaft 214 and, thus, the tray gear, which causes the output tray 204 to rotate due to corresponding teeth arranged on the output tray 204.

Figure 3:
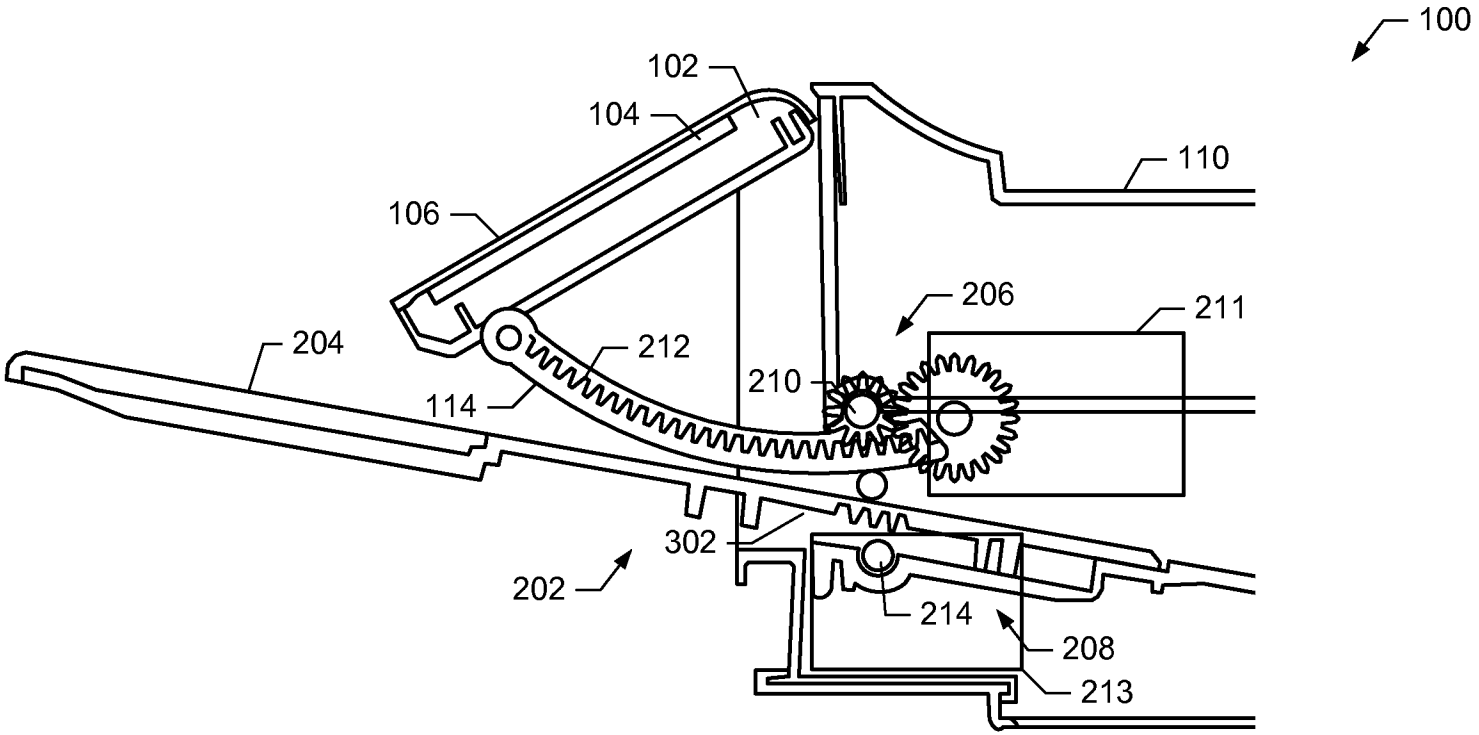
FIG. 3 is a cross-sectional view of the example printer of FIG. 1A with the control panel in a printing state and the print substrate path exit in an extended state.
Figure 7:
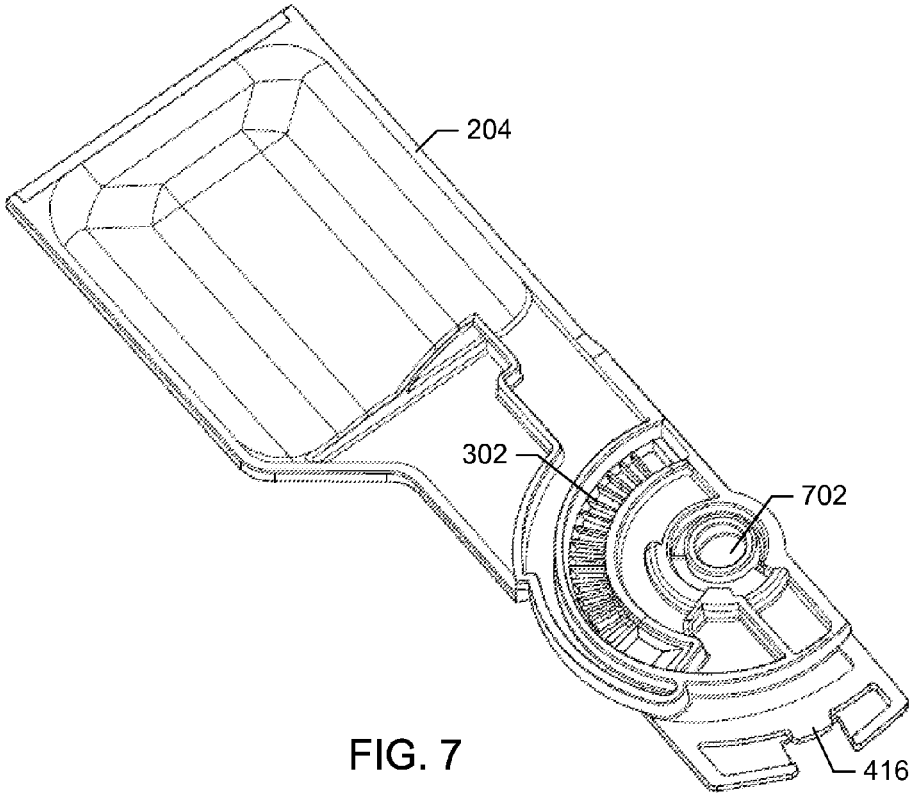
FIG. 7 illustrates the underside of an output tray that may be used to implement the example print substrate path exit of FIGS. 2-6.

FIG. 3 is a cross-sectional view of the example printer 100 of FIGS. 1A and 2 with the control panel 102 in a printing state and the print substrate path exit support 202 in an extended state. As illustrated in FIG. 3 and in contrast to the state of the printer 100 illustrated in FIG. 2, the control panel 102 does not obstruct the print substrate path exit support 202 when in the printing position. The example output tray 204 of FIG. 3 includes teeth 302 that interface with the tray gear coupled to the driveshaft 214. In the illustrated example, the print substrate path exit support 202 is rotatable between the idle position of FIG. 2 and the extended position of FIG. 3. As shown in FIG. 7, the example teeth 302 are arranged in an arc shape to match the rotation of the output tray 204 with respect to the tray gear.

FIG. 4 is a perspective view of the example printer 100 of FIG. 1B including the control panel 102 in the printing state and the print substrate path exit support 202 in the retracted state. As discussed above, the example printer 100 includes the control panel 102, the display 104, the touchscreen input 106, the housing 110, the control panel arm 114, the control panel actuator 206, and the output path actuator 208. The example control panel actuator 206 of FIG. 4 includes the arm gear 210, a driveshaft 402, a second arm gear 404, and a control panel motor 406. The example control panel actuator 206 of FIG. 4 further includes a second control panel arm 408 having teeth 410 to interface with the second arm gear 404. The example arm gears 210, 404 are journaled on the driveshaft 402 such that the gears 210, 404 rotate at equal rates.

The example output path actuator 208 of FIG. 4 includes the driveshaft 214 and an output path motor 412 coupled to the driveshaft 214. The output tray 204 rotates around a pivot point 414 and includes a retention tab 416 to retain the output tray 204 in a track 418 in the housing 110. To move the output tray 204 from the retracted state to the extended state, the example driveshaft output path output path motor 412 rotates the driveshaft 214 (and an attached tray gear) counterclockwise (with reference to FIG. 4), causing the teeth 302 to rotate the output tray 204 around the pivot point 414.

As shown in FIG. 4, the control panel 102 includes a cylindrical tab 420, which is inserted into a corresponding hole in the housing 110, and a similar tab on the opposite side of the control panel 102 which is inserted in a corresponding hole defined in the housing 110. In combination, the tabs form an axis about which the control panel 102 pivots.

The example printer 100 of FIG. 4 further includes star wheels 422 adjacent the print substrate path exit support 202. The example star wheels 422 are positioned to guide or depress sheets of print substrate toward the bottom of the print substrate path exit support 202. In particular, the star wheels 422 depress the trailing edge of the print substrate so that the leading edge of a subsequent print substrate sheet is output on top of earlier substrate sheet(s). In contrast, known printers allow some space in the output tray for the substrate sheets to fall prior to subsequent substrate sheets being output. Due to the relatively short profile of the example printer 100, the star wheels 422 are included to reduce the likelihood of a subsequent substrate sheet pushing an earlier substrate sheet out of the printer 100 or inadvertently changing the order of substrate sheets output from the printer 100 by interposing a subsequent substrate sheet between two earlier substrate sheets. Additional star wheels, rollers, and/or other paper path components may additionally be included to guide or urge a print substrate through a designated print substrate path in the printer 100.

FIG. 5 is a perspective view of the example printer 100 of FIG. 1A including a substrate detector 502. The example printer 100 uses the substrate detector 502 to detect whether a print substrate is present on the output tray 204. In some examples, a controller uses the substrate detector 502 to determine whether to retract the example output tray 204 and/or the control panel 102. For example, the controller does not retract the output tray 204 when a substrate is detected, because the substrate would fall from the printer 100 if such an action was taken.

The example substrate detector 502 of FIG. 5 is implemented using a pivoting flag that is biased to be oriented in a first position 504 (e.g., an "Up" state) when no substrate is present in the output tray 204 and in a second position 506 (e.g., a "Down" state) when a substrate is present in the output tray 204. In some examples, the output tray 204 forces the substrate detector 502 into a down state (e.g., the second position 506 or a third position) when the output tray 204 is in the retracted position. The printer 100 further includes a position detector 508 to determine a position of the example substrate detector 502. For example, the position detector 508 of FIG. 5 is a light sensor oriented such that the substrate detector 502 breaks a path between a light source and the light sensor when the substrate detector 502 is in the first position 504. If no substrate is present, the example substrate detector 502 is urged into the first position 504 by, for example, a torsion spring (not shown) coupled to the substrate detector 502 and to the housing 110.

During a print operation, the example printer 100 outputs a print substrate (e.g., a sheet of paper or other media) through the print substrate path exit support 202. At the start of the example print operation, there is no print substrate present on the output tray 204 and the substrate detector 502 is in the first position 504. As the print substrate travels to the exit support 202 over the output tray 204, the print substrate pushes the substrate detector 502 from the first position 504 to the second position 506. When the substrate detector 502 is in the second position 506, the substrate detector 502 opens the position detector 508 to receiving light from the light source. When the example position detector 508 detects light, the position detector 508 signals that a print substrate is present on the output tray 204.

At a later time, a user removes the print substrate (e.g., a printed sheet of paper) from the output tray 204. At that time, the substrate detector 502 is urged from the second position 506 to the first position 504 by, for example, a torsion spring coupled to the substrate detector 502 and a surface such as the housing 110. As a result, the substrate detector 502 blocks light from the light source from reaching the position detector 508. When the position detector 508 no longer detects the light from the light source, the position detector 508 signals that the print substrate has been removed from the output tray 204.

After the print substrate is removed (e.g., the print operation is complete), the example printer retracts the output tray 204. When the output tray 204 is retracted, it pushes the substrate detector 502 into a third position 510. When in the third position 510, the example substrate detector 502 opens the path of light such that the position detector 508 determines the substrate detector 502 is in a down state. The third position 510 may be used to detect that the output tray 204 is in a retracted position. To this end, some example printers include a second position detector to detect when the substrate detector 502 is in the third position 510. In such examples, the second position detector may not detect when the substrate detector 502 is in the second position 506.

Figure 6:
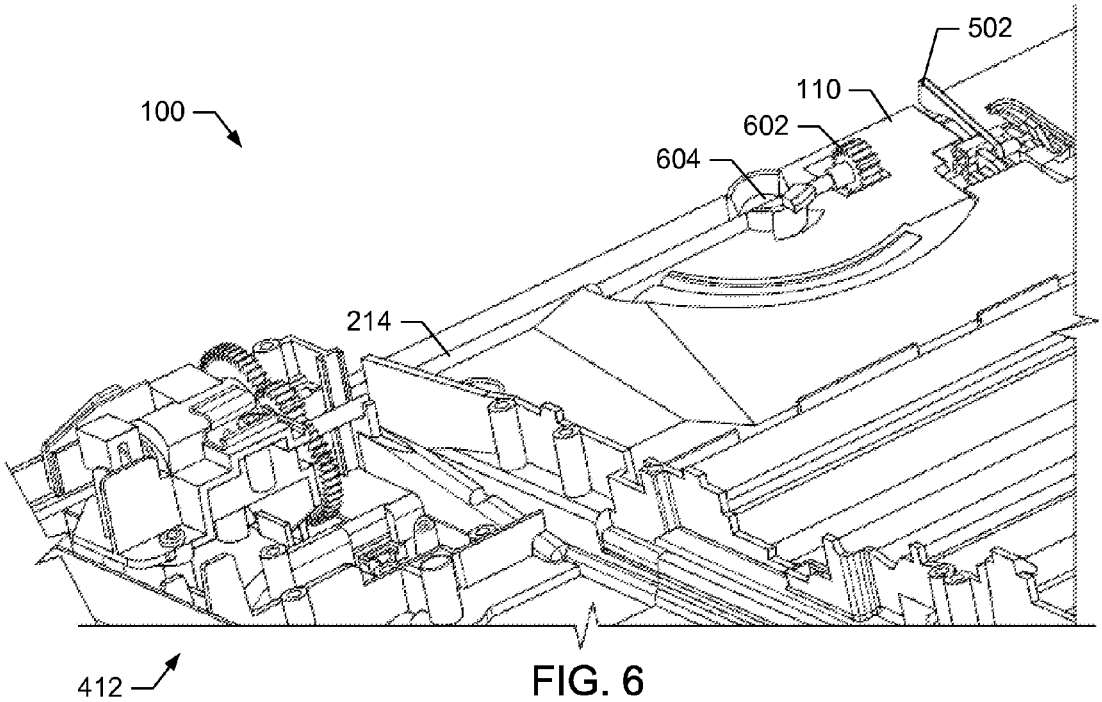
FIG. 6 is a perspective view of the example printer of FIG. 1A illustrating an example motor and an example tray gear to change a position of the print substrate path exit.

FIG. 6 is a perspective view of the example printer 100 of FIG. 1A illustrating an example output path motor 412 and an example tray gear 602 to change a position of the print substrate path exit support 202. The example output tray 204 rotates in response to the output path motor 412 rotating the gear 602. The example output tray 204 rotates between a retracted state (see, for example, FIG. 2) and an extended state or position (see, for example, FIG. 3). The example output path motor 412 selectively rotates the driveshaft 214 to rotate the gear 602. As a result of rotating the gear 602 counterclockwise (in the view shown in FIG. 6), the example output tray 204 rotates toward an extended position. Conversely, when the output path motor 412 rotates the driveshaft 214 and the gear 602 clockwise (in the view shown in FIG. 6), the output tray 204 rotates toward the retracted position. The example housing 110 further includes a pivot point 604 to support a corresponding pivot point 702 (see FIG. 7) on the output tray 204. As the gear 602 is turned to rotate the output tray 204, the example output tray 204 rotates on an axis running through the example pivot point 604.

FIG. 7 illustrates the underside of an output tray 204 of FIGS. 2-6. The example output tray 204 includes the teeth 302 and the retention tab 416. The example output tray 204 of FIG. 7 further includes a pivot point 702 corresponding to a pivot point 604 on the housing 110 of FIGS. 1A-6. The example teeth 302 are arranged in an arc centered relative to the pivot point 702. The teeth 302 mesh with the output tray gear 602 of FIG. 6. As shown in FIG. 6, the example output tray gear 602 and the pivot point 604 are in fixed positions relative to each other. Accordingly, the teeth 302 are arranged such that the output tray gear 602 interfaces substantially continuously with the teeth 302 as the output tray 204 is rotated.

In normal operation (e.g., no errors during printing), the example printer 100 of FIGS. 1A-7 (e.g., via the processor 1302 of FIG. 13) synchronizes the positioning of the control panel 102 and the output tray 204 with printing actions and interactions with the user. For example, the printer 100 is in a first, idle state at a first time (as illustrated in FIGS. 1A and 2). In the idle state, the example output tray 204 is retracted and the control panel 102 is closed (e.g., at least partially obstructing the area 112 through which the sheets of print substrate travel to exit the printer 100.

When the example printer 100 begins printing, the processor 1302 controls the timing of the movement of the control panel 102 and the output tray 204. For example, prior to the first sheet of print substrate exiting the printer 100, the processor 1302 controls the control panel motor 406 to move the control panel 102 to an open position (where the control panel 102 does not obstruct the area 112). Further, the example processor 1302 controls the output tray motor 412 to move the output tray 204 from a retracted position to an extended position after the control panel 102 is moved to an open position and before the first sheet of print substrate is output (e.g., printed) from the printer 100. Accordingly, the output tray 204 is in a position to support the sheet(s) of print substrate.

When the printer 100 completes printing, the example control panel 102 remains in the open position and the example output tray 204 remains in the extended position until a user removes the sheet(s) of print substrate from the output tray 204. The example processor 1302 detects the removal of the sheet(s) (e.g., via the substrate detector 502). In response to the removal of the sheet(s) of print substrate, the example processor 1302 controls the output tray motor 412 to retract the output tray 204 to a retracted position. When the output tray 204 reaches the retracted position, the processor 1302 controls the control panel motor 406 to move the control panel 102 to an idle or closed position that at least partially obstructs the example area 112 through which the sheets of print substrate travel to exit the printer 100.

Figure 8A:
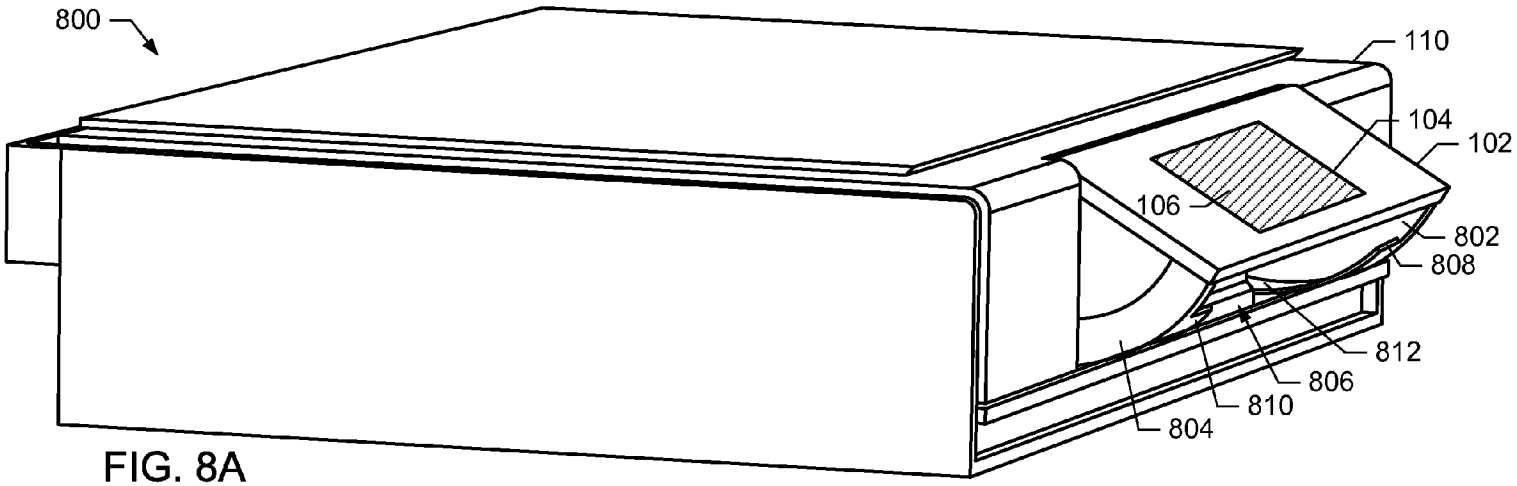
FIG. 8A illustrates another example printer constructed in accordance with the teachings of this disclosure and including a print substrate path exit to support a print substrate.

FIG. 8A illustrates another example printer 800 constructed in accordance with the teachings of this disclosure. The example printer 800 of FIG. 8 is similar in form factor (e.g., size and shape) to the example printer 100 of FIG. 1, and includes the example control panel 102, the example display 104, the example touchscreen input 106, and the example housing 110 of FIGS. 1A and 1B.

The example printer 800 of FIG. 8 further includes control panel arms 802, 804. The example arms 802, 804 of FIG. 8A are different from the example control panel arms 114, 408 of FIGS. 1A-6. In particular, the example control panel arms 802, 804 support both the control panel 102 in the printing position and sheets of print substrate that are output from the printer 800 via a print substrate path exit 806. Accordingly, the example printer 800 does not include the output tray 204, the driveshaft 214, the output tray motor 412, or the gear 602 of the printer 100.

To support the sheets of print substrate, the example arms 802, 804 of FIG. 8A include respective sheet support edges 808, 810 on their inner sides. The sheet support edge 810 of the illustrated example is partially obstructed by the example control panel arm 804, but is substantially similar to the sheet support edge 808. The example sheet support edge 808 is curved in the same shape as the arm 802 and has an upper surface 812 on which a sheet of print substrate may lay when output from the printer 800.

Figure 8B:
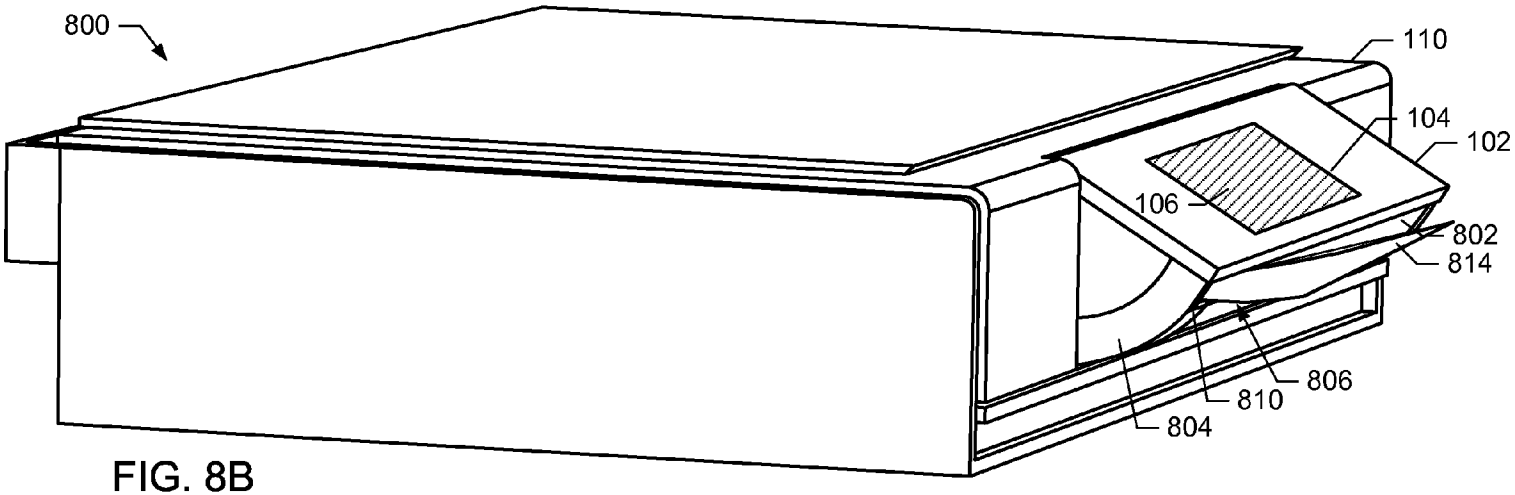
FIG. 8B illustrates the example printer of FIG. 8A supporting a print substrate in the print substrate exit.

When a printing operation is performed, the example printer 800 extends the control panel 102 to the printing position illustrated in FIGS. 8A and 8B. As a result, the sheet support edges 808, 810 are also positioned in an extended or support position in which the sheet support edges 808, 810 can support one or more sheets of print substrate exiting the printer 100. As the printer 800 generates prints, one or more sheets of print substrate are output via the print substrate path exit 806. The edges of the printed sheet rest on and are supported by the sheet support edges 808, 810, and the trailing edges of the sheet are supported by an inner surface of the housing 110. FIG. 8B illustrates the example printer 800 having a print substrate 814 supported by the sheet support edges 808, 810.

Like the printer 100 of FIGS. 1A-7, the example printer 800 may include additional features of a desktop or all-in-one printer, such as an image scanner, an input paper tray, a facsimile module, a modem, etc.

Flowcharts and/or state machines representative of example machine readable instructions 900, 1000, 1100, 1200 for implementing the printers and control panels of FIGS. 1A-7 and/or the example printers and control panels of FIGS. 8A, 8B are shown in FIGS. 9-12. In this example, the machine readable instructions 900, 1000, 1100, 1200 comprise a program for execution by a processor such as the processor 1302 shown in the example printer 1300 discussed below in connection with FIG. 13. The program may be embodied in software stored on a computer readable medium such as a CD-ROM, a floppy disk, a hard drive, a digital versatile disk (DVD), or a memory associated with the processor 1302, but the entire program and/or parts thereof could alternatively be executed by a device other than the processor 1302 and/or embodied in firmware or dedicated hardware. Further, although the example program is described with reference to the flowcharts and/or state machines illustrated in FIGS. 9-12, many other methods of implementing the example printers 100 and/or the example printers 800 may alternatively be used. For example, the order of execution of the blocks may be changed, and/or some of the blocks described may be changed, eliminated, or combined.

The example processes of FIGS. 9-12 may be implemented using coded instructions (e.g., computer readable instructions) stored on a tangible computer readable medium such as a hard disk drive, a flash memory, a read-only memory (ROM), a compact disk (CD), a digital versatile disk (DVD), a cache, a random-access memory (RAM) and/or any other storage media in which information is stored for any duration (e.g., for extended time periods, permanently, brief instances, for temporarily buffering, and/or for caching of the information). As used herein, the term tangible computer readable medium is expressly defined to include any type of computer readable storage and to exclude propagating signals. Additionally or alternatively, the example processes and/or states of FIGS. 9-12 may be implemented using coded instructions (e.g., computer readable instructions) stored on a non-transitory computer readable medium such as a hard disk drive, a flash memory, a read-only memory, a compact disk, a digital versatile disk, a cache, a random-access memory and/or any other storage media in which information is stored for any duration (e.g., for extended time periods, permanently, brief instances, for temporarily buffering, and/or for caching of the information). As used herein, the term non-transitory computer readable medium is expressly defined to include any type of computer readable medium and to exclude propagating signals.

The example instructions 900, 1000, 1100, 1200 may be executed to implement the example printer 100 of FIGS. 1A-7 and/or the example printer 800 of FIG. 8A, 8B. Specifically, the example printer 100 of FIGS. 1A-7 and/or the example printer 800 of FIGS. 8A, 8B may use the example instructions and/or state machines 900, 1000, 1100, 1200 of FIGS. 9-12 to operate a control panel that at least partially overlaps an exit path of a printer in a rest state and pivots out of the exit path in an extended state. For purposes of illustration and not by way of limitation, the example instructions 900, 1000, 1100, 1200 will be discussed with reference to the example printer 100 of FIGS. 1A-7 and/or the example printer 1300 of FIG. 13.

Figure 9:
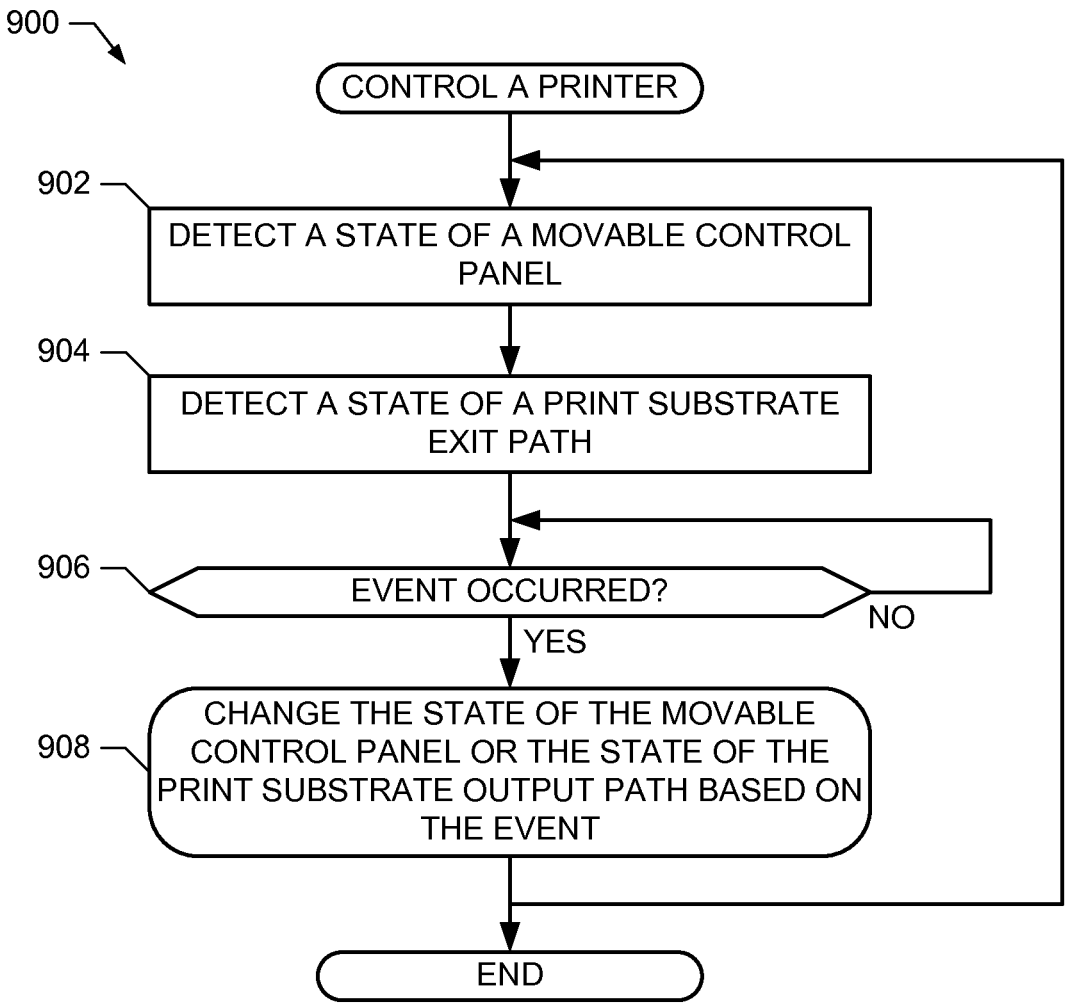
FIG. 9 is a flowchart representative of example machine readable instructions which may be executed to control the example printer of FIGS. 1A-7.

The example instructions 900 of FIG. 9 begin by detecting (e.g., via the processor 1302 of FIG. 13) a state of a movable control panel (e.g., the control panel 102 of FIG. 1) (block 902). For example, the processor 1302 may detect an idle state or a printing state of the control panel 102 based on reading a memory device. Additionally or alternatively, the processor 1302 may detect that the control panel 102 is in an unknown state (e.g., neither the idle state nor the printing state). In some examples, the processor 1302 stores a state of the control panel 102 in response to an event, such as starting a print operation, finishing a print operation, and/or detecting removal of print substrate from an output tray. When such events occur, the example processor 1302 stores the state of the control panel 102 after taking an action based on the event. In some other examples, the printer 100 includes a sensor (e.g., a magnet and a Hall effect sensor, a light source and light sensor, etc.) to determine a position of the control panel or a sensor (e.g., a current sense register to measure current drawn by the motor 406) to independently measure when the control panel 102 has reached an end of its track path (e.g., when the motor 406 draws increased current to attempt to drive the control panel 102 beyond the end of its track path).

The example processor 1302 of the printer 1300 also detects a state of a print substrate path exit (e.g., the print substrate path exit support 202, the output tray 204 of FIG. 2) (block 904). The state of the print substrate path exit support 202 may be, for example, extended (e.g., open, printing), retracted (e.g., closed, idle), and/or unknown. In some examples, the example processor 1302 detects the state of the print substrate path exit support 202 by reading a designated location in a memory device. For example, the processor 1302 stores a known state of the print substrate path exit support 202 in the designated location of the memory device after performing an action based on an event.

After determining the states of the example control panel 102 and the print substrate path exit support 202, the example processor 1302 determines whether an event has occurred (block 906). Example events include powering on, powering off, waking from sleep, entering sleep, print substrate being present in the print substrate path exit support 202, print substrate being removed from the print substrate path exit support 202, the expiration of a timer, a printing job starting, and/or a printing job finishing. The example processor 1302 detects some of the example events, such as a printing job starting and/or finishing and/or the expiration of a timer, via software commands and/or communications with another device. The processor 1302 detects others of the events by changes in the state of, for example, the substrate detector 502 (e.g., moving from the second position 506 to the first position 504 when a user removes a print substrate that was present in the print substrate path exit support 202). If an event has not occurred (block 906), the processor 1302 iterates to block 906 to monitor for an event.

When an event occurs (block 906), the example processor 1302 changes the state of the control panel 102 or the state of the print substrate path exit support 202 (e.g., by moving the output tray 204) based on the event (block 908). For example, the processor 1302 may retract the output tray 204 in response to a removal of a print substrate from the print substrate exit path event. In some examples, the processor 1302 changes the state of both the control panel 102 and the print substrate path exit support 202 based on the respective states of the control panel 102 and the print substrate path exit support 202 in response to an event. For example, the processor 1302 may cause the control panel 102 to move from an idle state to a printing state and cause the output tray 204 to move from a retracted state to an extended state in response to receiving and/or starting a printing task.

When the state(s) of the control panel 102 and/or the print substrate path exit support 202 has been changed, the example instructions 900 of FIG. 9 may end. Additionally or alternatively, the processor 1302 may iterate all or a portion of the instructions 900 to continue to respond to events. For example, the instructions 900 may iterate to block 906 after changing the state(s) of the control panel 102 and/or the print substrate path exit support 202 to determine whether another event has occurred. In some examples, the instructions 900 iterate in response to the printer 100 powering down and/or entering a sleep mode. When powering on and/or waking from the sleep mode, the example printer 100 begins at block 902 (e.g., to detect the state of the movable control panel 102). In some examples, the instructions 900 restart from any of the blocks 902-908 when a power down/power up event occurs.

Figure 10:
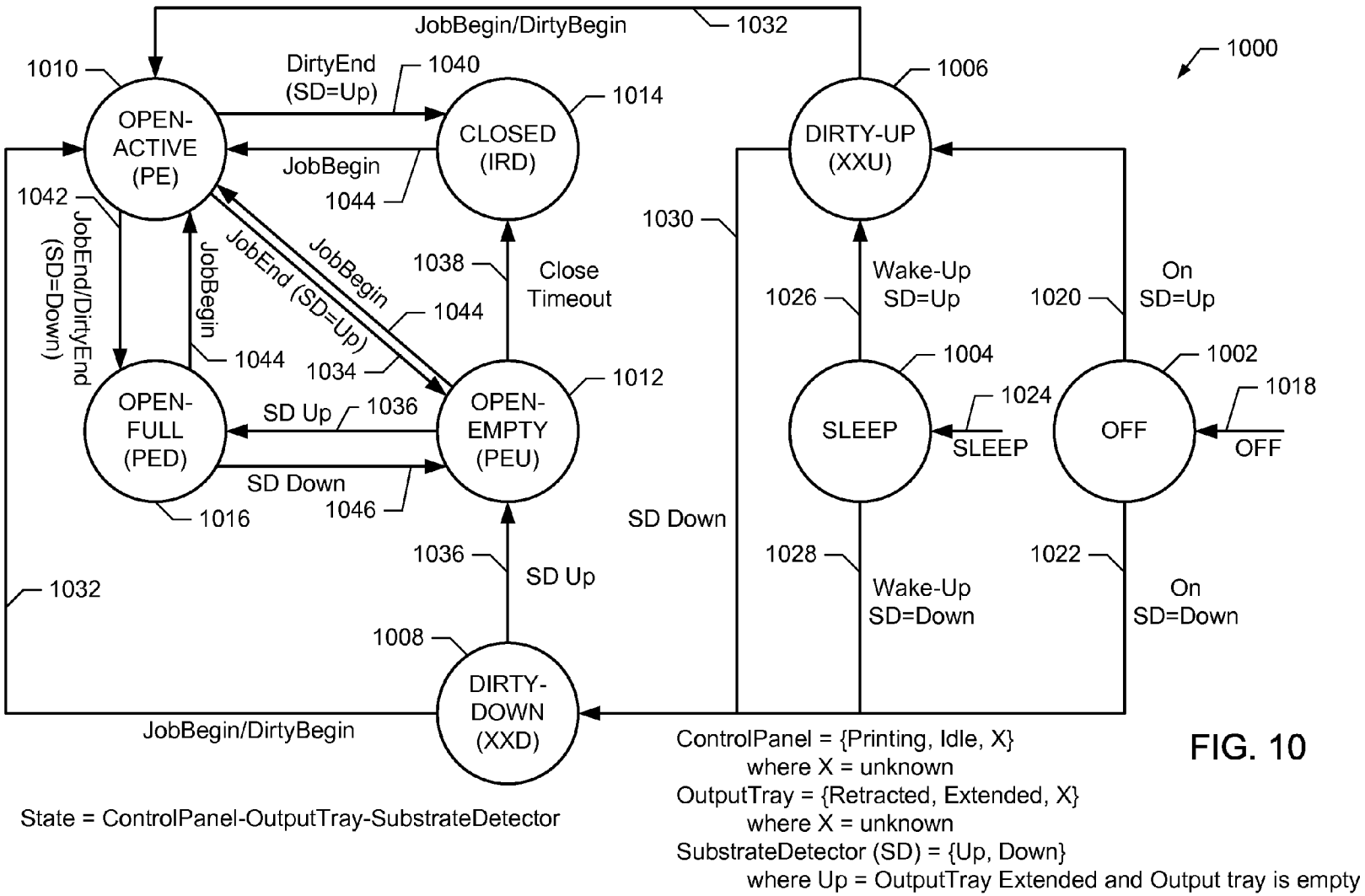
FIG. 10 illustrates an example state machine that may be used to control the example printer of FIGS. 1A-7.

FIG. 10 illustrates an example state machine 1000 that may be used to control the example printer 100 of FIGS. 1A-7. The example state machine 1000 includes example states 1002, 1004, 1006, 1008, 1010, 1012, 1014, 1016 and events that the example processor 1302 of the printer 1300 may use to control the states of the example control panel 102 and/or the example output tray 204 of FIGS. 1A-7. The state machine 1000 may be modified to be used to control the example printer 800 of FIGS. 8A and 8B by, for example, changing the states to omit the example OutputTray state variable. The example states 1002-1016 are illustrated in FIG. 10 as including a name of the state and the respective states in which the control panel 102 (e.g., Printing (P), Idle (I), and Unknown (X) states), the output tray 204 (e.g., Extended (E), Retracted (R), and Unknown (X) states), and the substrate detector 502 (e.g., Up (U), Down (D) states). Therefore, in the example Open-Full state illustrated in FIG. 10 (e.g., PED), the control panel 102 is in the printing (P) state, the output tray 204 is in the extended (E) state, and the substrate detector 502 is in the down (D) state. The printer 100 changes between the example states 1002-1016 in response to example events, which are described in more detail below.

When the control panel 102 is in the Printing state P, the control panel 102 is in a position in which it does not obstruct print substrate from exiting the printer 100 via the print substrate path exit support 202. FIGS. 1B, 3, 4, and 5 illustrate the control panel 102 in an example printing state. Conversely, when the control panel 102 is in the Idle state I, the control panel 102 is in a position in which it at least partially obstructs the print substrate path exit support 202. FIGS. 1A and 2 illustrate the control panel in an example Idle state I. However, in some examples a user may set the idle position of the control panel 102. Depending on the relative arrangement or configuration of the control panel 102 and the print substrate path exit support 202, in some examples an idle position may be selected or set by a user that partially obstructs or does not obstruct the print substrate path exit support 202.

The Unknown state X of FIG. 10 is reserved for situations when the processor 1302 is unable to detect the control panel 102 as being in either the Printing state P or the Idle state I. The Unknown state X may additionally or alternatively be actively detected by the processor 1302 by, for example, determining that the processor 1302 stored in a memory device an indication that a movement of the control panel 102 was initiated but that a counter-indication that the movement of the control panel 102 ended was not stored by the processor 1302.

When the example output tray 204 is in the Retracted state R, the output tray 204 is in a position in which it would not support a print substrate output from the printer 100. Examples of the output tray 204 in the Retracted state R are illustrated in FIGS. 2 and 4. When the example output tray 204 is in the Extended state E, the output tray 204 is in a position in which a print substrate output by the printer 100 would be supported in a position in which the user could receive the output print substrate without fully ejecting the print substrate from the printer 100. The Unknown output tray state X of FIG. 10 is similar to the Unknown control panel state in that it is reserved for situations when the processor 1302 cannot detect or is otherwise unaware of whether the output tray 204 is in the Retracted R or the Extended states E.

The example printer 100 enters the OFF state 1002 from any of the other states 1004-1016 in response to a power off event 1018. A power off event 1018 may include a user pushing a power button (e.g., the button 108 of FIG. 1A) or the printer 100 suffering a loss of power. From the OFF state 1002, the example printer 100 responds to an On event 1020, 1022 in a manner depending upon the state of the substrate detector 502. In a first On event 1020, the substrate detector 502 is in an "Up" state U (e.g., detected via the position detector 508 of FIG. 5), where no print substrate is present in the print substrate path exit support 202 when the "on" event occurs. Conversely, the On event 1022 occurs when the printer 100 is powered on while the substrate detector 502 is in a "Down" state D, when one or more print substrate(s) are present in the print substrate path exit support 202 (e.g., detected via the position detector 508).

The example printer 100 enters the SLEEP state 1004 in response to a SLEEP event 1024. The SLEEP event 1024 occurs in response to the expiration of a sleep timer. The sleep timer is tolled or turned on or off in response to other events, such as beginning or ending printing tasks, receiving user inputs, and/or other events that are indicative of active interaction with the printer 100.

During the example SLEEP state 1004, the user may change the position(s) of any of the control panel 102, the output tray 204, and/or the substrate detector 502. In some examples, the user may also change the position(s) of the control panel 102, the output tray 204, and/or the substrate detector 502 in the OFF state 1002. Accordingly, the example printer 100 does not track the positions of the control panel 102, the output tray 204, and/or the substrate detector 502 during the SLEEP state 1004 and assumes Unknown states for the control panel 102 and the output tray 204 when a wake-up event 1026 or 1028 occurs.

From the SLEEP state 1004, the example printer 100 responds to Wake-Up events 1026 and 1028. In a first Wake-Up event 1026, the printer 100 wakes with the substrate detector 502 in an "Up" state U (e.g., detected via the position detector 508). Conversely, the Wake-Up event 1028 occurs when the printer 100 wakes while the substrate detector 502 is in a "Down" state D, in which one or more print substrate(s) are present in the print substrate path exit support 202 (e.g., detected via the position detector 508).

When either of the event 1020 (e.g., from the OFF state 1002) or the event 1026 (e.g., from the SLEEP state 1004) occurs, the printer 100 changes to a Dirty-Up state 1006. In the Dirty-Up state, the controller 1300 is aware that the substrate detector 502 is in the Up state U. The states of the control panel 102 and the output tray 204 are Unknown (e.g., X, X) in the example Dirty-Up state 1006. From the Dirty-Up state 1006, the substrate detector 502 may change states from the Up state U to the Down state D (e.g., an SD Down event 1030). The example event 1030 may occur if, for example, the user places a print substrate back into the output tray 204.

If any of the On event 1022 (e.g., from the OFF state 1002), the Wake-Up event 1028 (e.g., from the SLEEP state 1004), or the SD Down event 1030 (e.g., from the Dirty-Up state 1006) occurs, the printer enters a Dirty-Down state 1008. In the example Dirty-Down state 1008 of FIG. 10, the substrate detector 502 is in the Down state D, and the states of the control panel 102 and the output tray 204 are Unknown (e.g., X, X). When entering the Dirty-Down state 1008 from any of the states 1002, 1004, 1006, the example printer 100 does not take any action with respect to the control panel 102 or the output tray 204.

Figure 11:
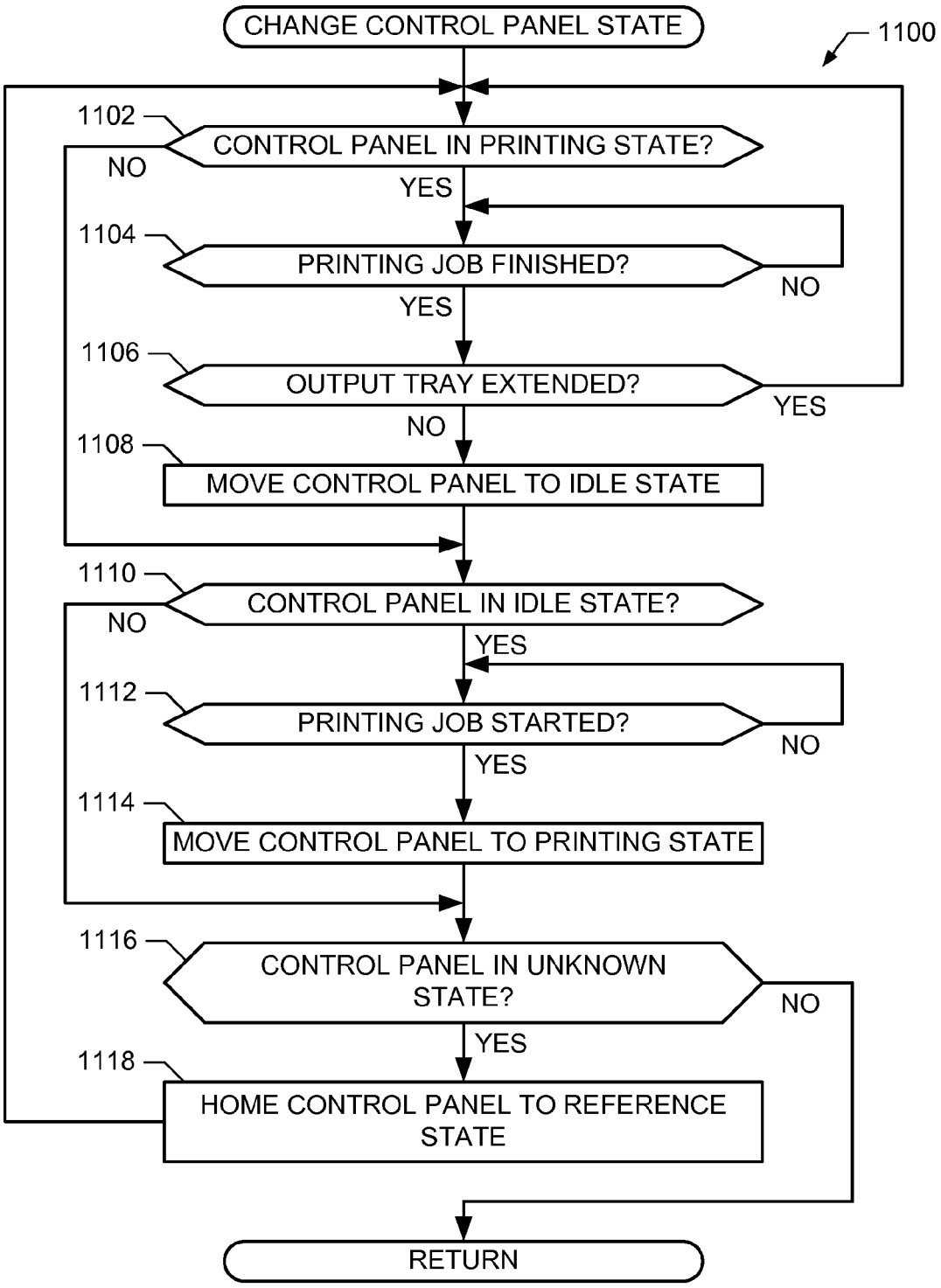
FIG. 11 is a flowchart representative of example machine readable instructions which may be executed to control a control panel state.
Figure 12:
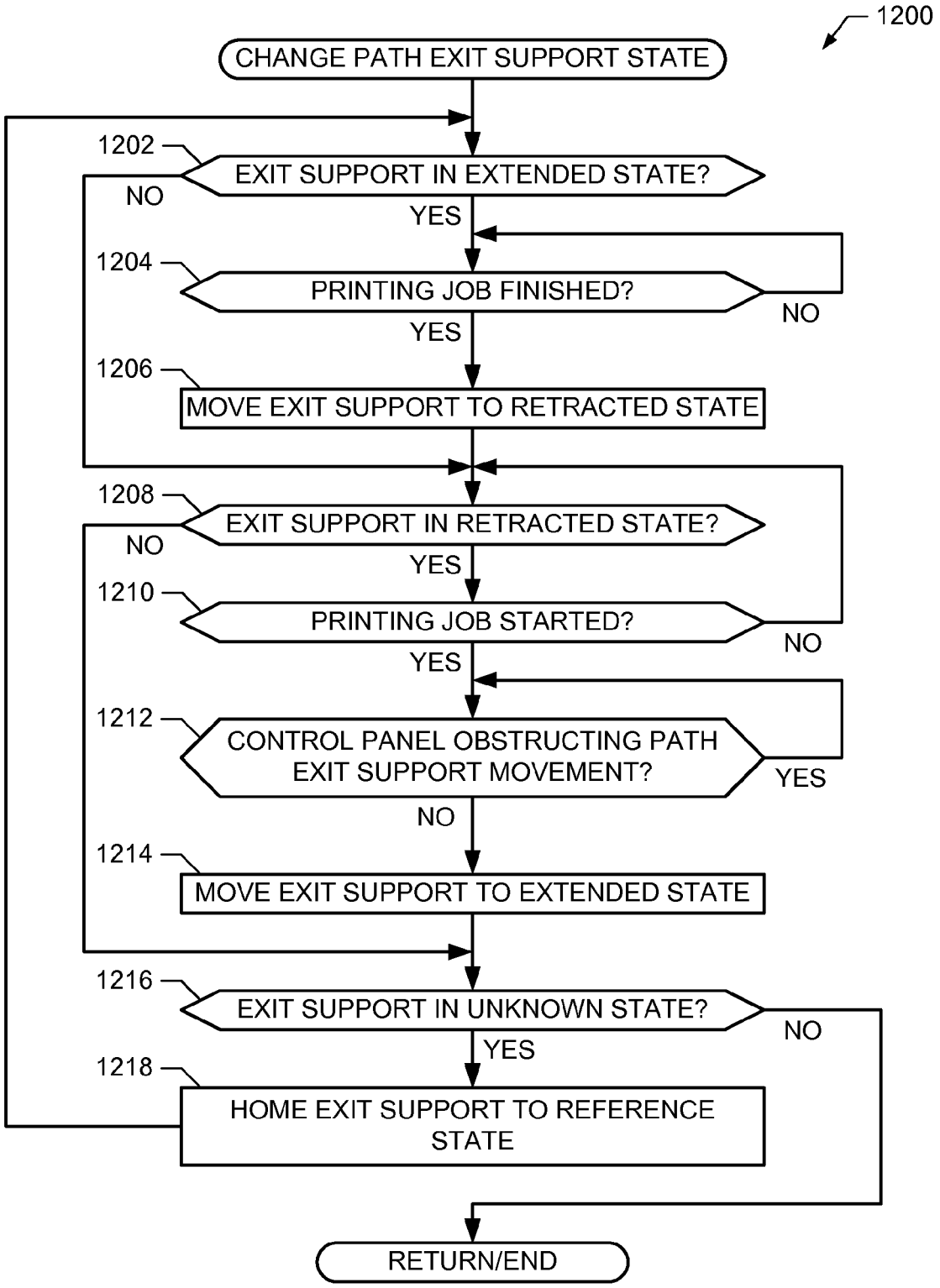
FIG. 12 is a flowchart representative of example machine readable instructions which may be executed to control a print substrate path exit state.

From either of the Dirty-Up state 1006 or the Dirty-Down state 1008, the example printer 100 enters an Open-Active state 1010 in response to a JobBegin/DirtyBegin event 1032. The JobBegin/DirtyBegin event 1032 of the illustrated example occurs in response to the receipt of a printing job or task that is to be performed by the printer 100. When entering the Open-Active state 1010 from the states 1006, 1008, the example processor 1302 runs a discovery process to determine the states of the control panel 102 and the output tray 204. Example instructions 1100, 1200 which may be executed to implement the discovery process are illustrated in FIGS. 11 and 12. As part of the discovery process, the processor 1302 causes the control panel 102 to enter the Printing state P and causes the output tray 204 to be in the Extended state E (if not already there) to enter the Open-Active state 1010. When in the Open-Active state 1010, the printer 100 may apply ink to one or more sheets of print substrate and output the printed sheets to the extended output tray 204. In the Open-Active state 1010, the control panel 102 is in the Printing state P and the output tray 204 is in the Extended state E (thus, PE). The substrate detector 502 may be in either the Up state U or the Down state D (or may change between the states U and D). The state of the substrate detector 502 may change between the Up state U and the Down state D as the printer 100 outputs sheet(s) of print substrate and/or as the user removes the sheets.

If the printing task ends properly (e.g., ends without an error or fault that causes the printing task to end prematurely) and the substrate detector 502 is in the Up state U (e.g., there are no sheets of print substrate in the output tray 204), the printer 100 receives a JobEnd event 1034 and moves to an Open-Empty state 1012. In the illustrated example, the printer 100 does not change the states of the control panel 102 or the output tray 204 in response to the event 1034. In the Open-Empty state 1010, the control panel 102 is in the Printing state P, the output tray 204 is in the Extended state E, and the substrate detector 502 is in the Up state U (and, thus, the Open-Empty state 1010 is marked PEU in FIG. 10).

The example printer 100 may additionally or alternatively enter the Open-Empty state 1010 from the Dirty-Down state 1008 in response to an SD Up event 1036 (e.g., the substrate detector 502 changing to an Up state). In the example of FIG. 10, the processor 1302 runs a discovery process in response to an SD Up event 1036 when changing states from the Dirty-Down state 1008.

From the example Open-Empty state 1012, the printer 100 may enter a Closed state 1014 in response to a Close Timeout event 1038. For example, the processor 1302 begins a close timer when the printer 100 enters the Open-Empty 1012. If no other events occur prior to the expiration of the close timer, the Close Timeout event 1038 occurs. The example printer 100 may additionally or alternatively enter the Closed state 1014 from the Open-Active state in response to a Dirty-End event 1040 in which the substrate detector 502 is in the Up state U. The Dirty-End event 1040 occurs when the printing task does not properly complete. In response to either of the events 1038 or 1040, the processor 1302 causes the output tray 204 to retract to the Retracted state R and causes the control panel 102 to move to the Idle state I. As the example output tray 204 retracts, the output tray 204 causes the substrate detector 502 to be changed to the Down state D. Thus, when the example printer 100 enters the Closed state 1014, the control panel 102 is in the Idle state I, the output tray 204 is in the Retracted state R, and the substrate detector 502 is in the Down state D (and, thus, the Closed state 1014 is marked IRD in FIG. 10).

The example printer 100 enters an Open-Full state 1016 from the Open-Active state 1010 in response to a JobEnd or Dirty-End event 1042 in which the substrate detector 502 is in a Down state D (e.g., there is print substrate in the output tray 204). In the Open-Full state 1016, the example control panel 102 is in the Printing state P, the output tray 204 is in the Extended state E, and the substrate detector 502 is in the Down state E (and, thus, the Open-Full state is marked PED in FIG. 10). In the illustrated example, the printer 100 does not change the states of the control panel 102 or the output tray 204 in response to the event 1042.

The example printer 100 enters the Open-Active state 1010 from any of the states 1012, 1014, or 1016 in response to a JobBegin event 1044. When the printer 100 is in the Open-Empty state 1012 or the Open-Full state 1016, the printer 100 does not change the state(s) of the control panel 102 or the output tray 204. On the other hand, the printer 100 changes the state of the control panel 102 from Idle I to Printing P and changes the state of the output tray 204 from Retracted R to Extended E in response to the JobBegin event 1044 when the printer 100 is in the Closed state 1014.

The printer 100 changes between the Open-Empty state 1012 and the Open-Full state 1016 in response to the SD-Up event 1036 or the SD-Down event 1046. The example printer 100 does not change the state(s) of the control panel 102 or the output tray 204 when changing between the Open-Empty state 1012 and the Open-Full state 1016.

Figure 13:
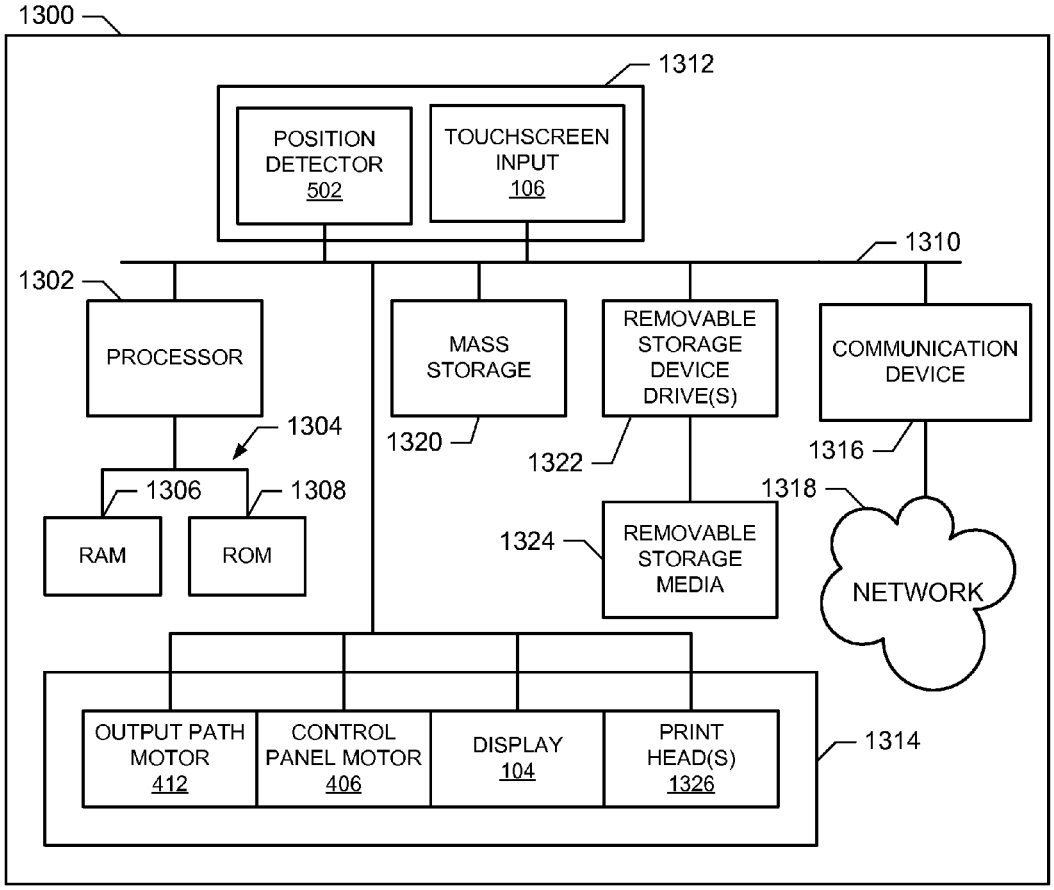
FIG. 13 is a block diagram of an example machine capable of executing the instructions of FIGS. 9-12 to implement the printers of FIGS. 1A-7 and/or 8A, 8B.

FIG. 11 is a flowchart illustrating example instructions 1100 which may be performed by the example processor 1302 to implement the example printer 100 of FIGS. 1A-7 and/or the example printer 1300 of FIG. 13. The example instructions 1100 may be performed to implement at least a portion of the discovery process discussed above with reference to FIG. 10 and/or to change a state of the printer 100.

The example instructions 1100 of FIG. 11 begin by determining (e.g., via the example processor 1302) if the control panel (e.g., the control panel 102 of FIGS. 1A-7) is in a Printing state P (block 1102). For example, the control panel 102 of FIG. 1 is in the Printing state P when the example printer 100 is in any of the Open-Active state 1010, the Open-Empty state 1012, or the Open-Full state 1016 of FIG. 10. In some other examples, the processor 1302 receives a signal from a detector identifying that the control panel 102 is in the Printing state P and/or from a detector failing to identify that the control panel 102 is in the Idle state I. If the control panel 102 is in the Printing state P (block 1102), the processor 1302 determines whether a printing job is finished (block 1104). For example, the processor 1302 determines that the printing job is finished if the processor 1302 receives a JobEnd event or a DirtyEnd event (e.g., the events 1034, 1040, 1042 of FIG. 10). If the processor 1302 does not determine that the printing job is finished (block 1104), control loops to block 1104 to continue to determine whether the printing job is finished (e.g., to wait for a JobEnd event or a DirtyEnd event).

After determining that a printing job is finished (block 1104), the example processor 1302 determines whether an output tray (e.g., the output tray 204 of FIG. 2) is in an Extended state E (block 1106). In the examples of FIGS. 1A-7, the control panel 102 is not able to move from a Printing state P to an Idle state I when the output tray 204 remains in the Extended state E. The example processor 1302 determines whether the output tray 204 is extended by determining whether an event has occurred that would cause the output tray 204 to move to or exist in a Retracted state R. In some other examples, the processor 1302 receives a signal from a detector identifying that the output tray 204 is in the Retracted state R and/or from a detector failing to identify that the output tray 204 is in the Extended state E. If the example output tray 204 is in the Extended state (block 1106), control returns to block 1102 to determine whether the control panel 102 is in the Printing state P. For example, after a printing job is finished but before the processor 1302 detects that the output tray 204 is in the Retracted state R, the processor 1302 may receive another printing job and, thus, fail to move the output tray 204 to the Retracted position R.

If the example output tray is in the Extended state E (block 1106), the printer 100 moves the control panel 102 to the Idle state I (block 1108). For example, the processor 1302 may cause the control panel motor 406 to rotate the gears 210 and 404 of FIGS. 2 and 4 to move the control panel 102 via the arms 114, 408 to an idle position such as the position illustrated in FIG. 2.

After moving the control panel 102 to the Idle state I (block 1108) and/or after determining that the control panel 102 is not in the Printing state P (block 1102), the example processor 1302 determines whether the control panel 102 is in the Idle state I (block 1110). For example, the processor 1302 may determine that the control panel 102 is in the Idle state I based on the printer 100 being in the Closed state 1014. Additionally or alternatively, the processor 1302 may receive a signal from a detector identifying that the control panel 102 is in the Idle state I and/or from a detector failing to identify that the control panel 102 is in the Printing state P.

If the control panel 102 is in the Idle state I (block 1110), the example processor 1302 determines whether a printing job has started (block 1112). For example, the processor 1302 may determine that a printing job has started by receiving the JobBegin event 1044. If a printing job has not been started (block 1112), control iterates to block 1112 to monitor for a printing job starting.

If a printing job has started (block 1112), the example printer 100 moves the control panel 102 to the Printing state P (block 1114). To move the control panel 102 to the Printing state P, the example printer 100 may cause the control panel motor 406 to rotate the gears 210 and 404 of FIGS. 2 and 4 to move the control panel 102 via the arms 114, 408 to a printing position such as the position illustrated in FIG. 3.

After moving the control panel 102 to the Printing state P (block 1114) and/or if the control panel 102 is not in the Idle state I (block 1110), the processor 1302 determines whether the control panel 102 is in an Unknown state X (block 1116). For example, the processor 1302 may determine that the control panel 102 is in the Unknown state X when the printer 100 is in the Dirty-Up state 1006 and/or the Dirty-Down state 1108 (e.g., when the printer 100 wakes from the SLEEP state 1004 and/or turns on from the OFF state 1002 of FIG. 10). If the control panel 102 is in the Unknown state X (block 1116), the processor 1302 homes the control panel 102 to a reference state (block 1118). For example, the processor 1302 may execute a discovery process by causing the control panel 102 to move in a first direction (e.g., toward the Printing state P, an open state in which the control panel 102 does not block the print substrate path exit support 202) to a first limit and then in a second direction (e.g., toward the Idle state I, a closed state in which the control panel 102 blocks the print substrate path exit support 202) to a second limit. As discussed above, the example gears 210, 404 are coupled to the control panel motor 406 via a spring friction clutch. When either the first limit or the second limit of motion is achieved, the spring friction clutch slips to keep the control panel 102 at the achieved limit. After this discovery process, the processor 1302 knows the position of the control panel 102 and may move the control panel 102 to a desired position from the reference position. After homing the control panel 102 (e.g., running the discovery process, determining the position of the control panel 102), control returns to block 1102 to determine whether the example control panel 102 is in the Printing state P.

If the control panel 102 is not in the Unknown state X (block 1116), the example instructions 1100 may end. Alternatively, the example processor 1302 may iterate the instructions 1100 to monitor and/or control the state of the control panel 102.

FIG. 12 is a flowchart illustrating example instructions 1200 which may be performed to implement the example printer 100 of FIG. 1 and/or the example processor 1302 of the printer 1300 of FIG. 13 to control a print substrate output path state in accordance with the teachings disclosed herein. In some examples, the instructions 1200 of FIG. 12 are executed concurrently or substantially concurrently with the example instructions 1100 of FIG. 11 to control both the control panel 102 and the output tray 204 of FIGS. 1A-7 simultaneously.

The example instructions 1200 begin by determining (e.g., via the example processor 1302) if the print substrate path exit support 202 (e.g., the output tray 204 of FIGS. 2-7) is in an Extended state E (block 1202). For example, the output tray 204 of FIG. 2 is in the Extended state E when the example printer 100 is in any of the Open-Active state 1010, the Open-Empty state 1012, or the Open-Full state 1016 of FIG. 10. In some other examples, the processor 1302 receives a signal from a detector identifying that the output tray 204 is in the Extended state E and/or from a detector failing to identify that the output tray 204 is in the Retracted state R. If the output tray 204 is in the Extended state E (block 1202), the processor 1302 determines whether a printing job is finished (block 1204). For example, the processor 1302 determines that the printing job is finished if the processor 1302 receives a JobEnd event or a DirtyEnd event (e.g., the events 1034, 1040, 1042 of FIG. 10). If the processor 1302 does not determine that the printing job is finished (block 1204), control loops to block 1204 to continue to determine whether the printing job is finished (e.g., to wait for a JobEnd event or a DirtyEnd event).

After determining that a printing job is finished (block 1204), the printer 100 moves the output tray 204 to the Retracted state R (block 1206). For example, the processor 1302 may cause the output path motor 412 to rotate the gear 602 of FIG. 6 to move the output tray 204 via the driveshaft 214 to a Retracted state R such as the position illustrated in FIG. 2.

After moving the output tray 204 to the Retracted state R (block 1206) and/or after determining that the output tray 204 is not in the Extended state E (block 1202), the example processor 1302 determines whether the output tray 204 is in the Retracted state R (block 1208). For example, the processor 1302 may determine that the output tray 204 is in the Retracted state R based on the printer 100 being in the Closed state 1014. Additionally or alternatively, the processor 1302 may receive a signal from a detector identifying that the output tray 204 is in the Retracted state R and/or from a detector failing to identify that the output tray 204 is in the Extended state E. In some examples where the output tray 204 causes the substrate detector 502 to be in a Down state D when the output tray 204 is in the Retracted state R, the processor 1302 may identify that the output tray is in the Retracted state R by detecting that the substrate detector 502 is in the Down state D and that the control panel 102 is in the Idle state I.

If the output tray 204 is in the Retracted state R (block 1208), the example processor 1302 determines whether a printing job has started (block 1210). For example, the processor 1302 may determine that a printing job has started by receiving the JobBegin event 1044. If a printing job has not been started (block 1210), control iterates to block 1210 to monitor for a printing job starting.

If a printing job has started (block 1210), the example processor 1302 determines whether the control panel 102 of FIGS. 1A-7 is obstructing movement of the output tray 204 (block 1212). For example, the control panel 102 may obstruct movement of the output tray 204 if the control panel 102 is in an Idle state. If the control panel 102 is obstructing movement of the exit support 202 (block 1212), control returns to block 1212 to determine whether the control panel 102 is obstructing movement of the output tray 204. For example, iterating block 1212 may allow concurrent execution and progression of the example instructions 1100 to move the control panel 102. If the control panel 102 is not obstructing movement of the output tray 204, the example printer 100 moves the output tray 204 to the Extended state E (block 1214). To move the output tray 204 to the Extended state E, the example printer 100 may cause the output path motor 412 to rotate the gear 602 of FIG. 6 via the driveshaft 214 to move the output tray 204 to extended position such as the position illustrated in FIG. 3.

After moving the output tray 204 to the Extended state E (block 1214) and/or if the output tray 204 is not in the Retracted state R (block 1208), the processor 1302 determines whether the output tray 204 is in an Unknown state X (block 1216). For example, the processor 1302 may determine that the output tray 204 is in the Unknown state X when the printer 100 is in the Dirty-Up state 1006 and/or the Dirty-Down state 1008 (e.g., when the printer 100 wakes from the SLEEP state 1004 and/or turns on from the OFF state 1002 of FIG. 10). If the output tray 204 is in the Unknown state X (block 1216), the processor 1302 homes the output tray 204 to a reference state (block 1218). For example, the processor 1302 may execute a discovery process by causing the output tray 204 to move in a first direction (e.g., toward the Extended state E) to a first limit and then in a second direction (e.g., toward the Retracted state R) to a second limit. As discussed above, the example driveshaft 214 and the example gear 602 are coupled to the output path motor 412 via a gear set. When either the first limit or the second limit of motion is achieved, the output path motor 412 keeps the output tray 204 at the achieved limit. After this discovery process, the processor 1302 knows the position of the output tray 204 and may move the output tray 204 to a desired position from the reference position. After homing the output tray 204 (e.g., running the discovery process, determining the position of the output tray 204), control returns to block 1202 to determine whether the example output tray 204 is in the Extended state E.

If the output tray 204 is not in the unknown state (block 1216), the example instructions 1200 may end. Alternatively, the example processor 1302 may iterate the instructions 1200 to monitor and/or control the state of the output tray 204.

FIG. 13 is a block diagram of an example printer 1300 capable of executing the instructions of FIGS. 9, 11, and 12 to implement the printer 100 of FIGS. 1A-7 and/or the example state machine 1000 of FIG. 10. The example printer 1300 may additionally or alternatively implement the example printer 800 of FIGS. 8A and 8B. The printer 1300 can be, for example, a printer or other image forming apparatus or any other type of device to execute printing and/or other functions (e.g., scanning, curing, faxing, etc.). The printer 1300 of the instant example includes a processor 1302. For example, the processor 1302 can be implemented by one or more microprocessors, embedded microcontrollers, system on a chip (SoC), and/or any other type of processing, arithmetic, and/or logical unit.

The processor 1302 is in communication with a main memory 1304 including a volatile memory 1306 and a non-volatile memory 1308. The volatile memory 1306 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 1308 may be implemented by read-only memory (ROM), flash memory, and/or any other desired type of memory device. Access to the main memory 1304 is controlled by a memory controller.

The printer 1300 also includes an interface circuit, such as a bus 1310. The bus 1310 may be implemented by any type of interface standard, such as an Ethernet interface, a universal serial bus (USB), and/or a PCI express interface.

Input device(s) 1312 are connected to the bus 1310. The input device(s) 1312 permit a user to enter data and commands into the processor 1302. The input device(s) 1312 can be implemented by, for example, a keyboard, a programmable keypad, a mouse, a touchscreen, a track-pad, a trackball, isopoint, and/or a voice recognition system. In the illustrated example of FIG. 13, the input device(s) 1312 include the example touch screen input 106 of FIGS. 1A-5 and the example position detector 502 of FIGS. 5 and 6.

Output device(s) 1314 are also connected to the bus 1310. The example output device(s) 1314 of FIG. 13 are implemented, for example, by display devices (e.g., a liquid crystal display, a cathode ray tube display (CRT), and/or speakers), etc.

The processor 1302 of the illustrated example provides commands and/or signals to the example control panel motor 406 and/or the example output path motor 412 via the bus 1310. The commands and/or signals from the processor 1302 control the example control panel motor 406 to move the control panel 102 between a printing position and an idle position and/or to control the output path motor 412 to extend and/or retract the output tray 204. As a result, the example processor 1302 of FIG. 13 enables a printer in which it is implemented (e.g., the example printer 100 of FIGS. 1A-7, the example printer 800 of FIGS. 8A, 8B) to use a control panel and a print substrate path exit that at least partially overlap, thereby saving space in the design of the printer 100.

In some examples the bus 1310 includes a graphics driver card to output graphics on a display device such as the display 104. The example bus 1310 also includes a communication device 1316 such as a wired or wireless network interface card to facilitate exchange of data (e.g., images to be formed on a substrate) with external computers via a network 1318.

The example printer 1300 of FIG. 13 further includes mass storage device(s) 1320 and removable storage drive(s) 1322 for storing software and data. Machine readable removable storage media 1324 may be inserted into the removable storage drive 1322 to allow the removable storage drive 1322 to provide the instructions contained on the media 1324 to, for example, the processor 1302. Examples of such mass storage devices 1320 and/or computer readable media include floppy disks, hard drive disks, compact discs (CDs), digital versatile discs (DVDs), memory cards, Universal Serial Bus (USB) storage drives, and/or any other articles of manufacture and/or machine readable media capable of storing machine readable instructions such as the coded instructions 800 of FIG. 8. Accordingly, the coded instructions 800 of FIG. 8 may be stored in the machine readable removable storage media 1324, the mass storage device 1320, in the volatile memory 1306, and/or in the non-volatile memory 1308.

From the foregoing disclosure, it will be appreciated that example methods and/or apparatus disclosed herein may be used to implement a printer having a control panel that at least partially overlaps with a print substrate path exit. In particular, disclosed example methods, printers, and control panels for printers overcome the user interface problems associated with known printers by using exterior area of the printer for both the user interface (e.g., the control panel) and the print substrate path exit. Thus, example methods, printers, and/or control panels for printers disclosed herein provide an enhanced user experience and ease of use for printers. Additionally or alternatively, disclosed example methods, printers, and/or control panels for printers enable a profile reduction of a printer while enabling equivalent or superior functionality and/or features compared to known printers.

Although certain example apparatus, printers, and methods have been described herein, the scope of coverage of this patent is not limited thereto. On the contrary, this patent covers all methods and apparatus fairly falling within the scope of the claims of this patent.

What is claimed is:

1. A printer, comprising:

a control panel;

a print substrate path exit to output a print substrate from the printer; and a control panel actuator to move the control panel from (a) a first position in which the control panel prevents the print substrate from passing through the print substrate path exit to (b) a second position in which the control panel does not obstruct the print substrate from passing through the print substrate path exit.

2. A printer as defined in claim 1, wherein the control panel actuator is to pivot the control panel between the first position and the second position.

3. A printer as defined in claim 1, further comprising an output tray to hold a print substrate when the output tray is in an extended position.

4. A printer as defined in claim 3, further comprising an output tray actuator to move the output tray from a retracted position to the extended position.

5. A printer as defined in claim 4, further comprising a substrate detector to determine whether a print substrate is present on the output tray.

6. A printer, comprising:

a control panel;

a print substrate path exit to output a print substrate from the printer;

a control panel actuator to move the control panel from a first position in which the control panel at least partially obstructs the print substrate from passing through the print substrate path exit to a second position in which the control panel does not obstruct the print substrate from passing through the print substrate path exit;

an output tray to hold a print substrate when the output tray is in an extended position;

an output tray actuator to move the output tray from a retracted position to the extended position; and a substrate detector to determine whether a print substrate is present on the output tray, wherein the output tray actuator is to move the output tray from the extended position to the retracted position when the substrate detector determines that a print substrate is not present on the output tray.

7. A printer as defined in claim 3, further comprising a controller to determine at least one of a control panel position or an output tray position.

8. A printer as defined in claim 1, wherein the control panel comprises a display and at least one input device.

9. A printer, comprising:

a control panel;

a print substrate path exit to output a print substrate from the printer;

a control panel actuator to move the control panel from a first position in which the control panel at least partially obstructs the print substrate from passing through the print substrate path exit to a second position in which the control panel does not obstruct the print substrate from passing through the print substrate path exit; and a first tab and a second tab positioned to support opposite edges of the print substrate.

10. A printer as defined in claim 9, wherein the first tab is coupled to an arm, the arm to support the control panel in the second position.

11. A printer, comprising:

an input device to receive an input;

a display device to display an output;

a support to move the input device and the display device between a first position and a second position;

a control panel actuator to drive the support, and a controller to determine a current position of the support and to control the control panel actuator to selectively move the support between the first position and the second position based on the current position and based on a state of a printer.

12. A method to operate a printer, comprising:

detecting a first state of a movable control panel;

detecting a second state of a movable print substrate path exit support; and changing at least one of the first state or the second state based on an event.

13. A method as defined in claim 12, wherein the first state is at least one of a printing state, an idle state, or an unknown state.

14. A method as defined in claim 13, wherein changing the second state comprises moving the print substrate path exit support to a reference position in response to at least one of a wake-up event or powering on.

15. A method as defined in claim 14, wherein changing the first state comprises moving the control panel to the reference position in response to at least one of a wake-up event or powering on.

16. A method as defined in claim 12, wherein the second state is at least one of an extended state, a retracted state, or an unknown state.

17. A method as defined in claim 12, wherein the event comprises at least one of powering on, powering off, waking from sleep, entering sleep, a print substrate being present in the print substrate path exit, no print substrate being present in the print substrate path exit, the expiration of a timer, a printing job starting, and/or a printing job finishing.

18. A method as defined in claim 12, wherein changing the first state comprises at least one of controlling a motor to move the control panel to a printing state in response to a print event or controlling the motor to move the control panel to an idle position in response to powering off or the print substrate being removed from the print substrate path exit.

19. A method as defined in claim 12, wherein changing the first state is based on the second state.

* * * * *